US008186825B2

(12) United States Patent
Kayanaka

(10) Patent No.: US 8,186,825 B2
(45) Date of Patent: May 29, 2012

(54) PRINTING APPARATUS

(75) Inventor: Yoshihisa Kayanaka, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 346 days.

(21) Appl. No.: 12/379,163

(22) Filed: Feb. 13, 2009

(65) Prior Publication Data

US 2009/0237428 A1 Sep. 24, 2009

(30) Foreign Application Priority Data

Mar. 24, 2008 (JP) ..... 2008-075698

(51) Int. Cl.
*B41J 2/01* (2006.01)

(52) U.S. Cl. ..... 347/104; 347/2; 346/33 R

(58) Field of Classification Search ..... 347/2, 5, 347/9, 12, 104; 346/33 R
See application file for complete search history.

(56) References Cited

U.S. PATENT DOCUMENTS 4,608,575 A * 8/1986 Morgan ..... 346/33 R
7,134,749 B2 11/2006 Ben-Zur et al.
7,338,155 B2 3/2008 Niimi
2005/0068400 A1 * 3/2005 Niimi et al. ..... 347/104
2005/0179708 A1 8/2005 Ben-Zur

FOREIGN PATENT DOCUMENTS

JP A-2004-268506 9/2004
JP A-2007-525339 9/2007
WO WO2005/076730 A2 8/2005
WO WO 2007/147175 A2 12/2007

OTHER PUBLICATIONS

European Search Report issued Jul. 21, 2009.

* cited by examiner

*Primary Examiner* — Lam S Nguyen
(74) *Attorney, Agent, or Firm* — Oliff & Berridge, PLC

(57) ABSTRACT

A printing apparatus, having at least two platens, at least one print head, at least one print head drive unit to drive the print head in a main scanning direction, at least two platen drive units to drive the platens in an auxiliary direction, at least one ink cartridge, at least two operation input units to be operated by an operator to instruct the printing apparatus to activate a first printing process and a second printing process respectively, and a cooperation controller system to control the print head, the print head drive unit, the first platen drive unit, and the second platen drive unit to behave in cooperation with one another so that the second printing process is started one of after and during the first printing process when an instruction to start the second printing process is entered whilst the first printing process is in progress, is provided.

7 Claims, 11 Drawing Sheets

PRINTING APPARATUS

CROSS REFERENCE TO RELATED APPLICATION

This application claims priority from Japanese Patent Application No. 2008-075698, filed on Mar. 24, 2008, the entire subject matter of which is incorporated herein by reference.

BACKGROUND

1. Technical Field

An aspect of the present invention relates to a printing apparatus, more specifically, a printing apparatus to print images on fabrics.

2. Related Art

Conventionally, a printing apparatus for printing an image on a piece of fabric, having a platen to hold the fabric, a print head to eject inks onto the fabric, a carriage to move the print head, an operation plane, and a set of colored inks, has been known. Such a printing apparatus is disclosed in, for example, Japanese Patent Provisional Publication No. 2004-268506. According to the printing apparatus, an image represented by a piece of print data is formed on a piece of fabric as the carriage is moved in a main scanning direction and the platen is moved in an auxiliary direction.

For another example, in United States Patent Application Publication No. US 2005/0179708 A1, a printing apparatus having a plurality of platens to hold a plurality of pieces of fabric aligned on a same horizontal plane is disclosed. According to the latter publication, two images are successively formed on the respective pieces of fabric in inks ejected from a print head so that the images can be formed successively on the plurality of pieces of fabric in shorter lead time.

When the images are formed in the printing apparatus disclosed in the latter publication, an operator can remove a piece of fabric with the image being formed from one of the platens and load a new piece of fabric thereon while an image is formed on another piece of fabric loaded on the other platen so that the images can be formed continuously and thus efficiently.

SUMMARY

When the images are formed successively on the pieces of fabric placed on two platens, although it is not explicitly described in the above mentioned publications, it is assumed that the operator is generally required to stand by the printing apparatus and await a current printing operation to the fabric placed on one platen to be completed so that an instruction to start a printing operation to the fabric placed on the other platen can be entered upon completion of the current printing operation. Therefore, the waiting periods to reduce work efficiency of the operator are caused.

In view of the above, the present invention is advantageous in that a printing apparatus capable of printing images successively with less waiting periods for an operator so that work efficiency of the operator is improved, is provided.

According to an aspect of the invention, a printing apparatus capable of forming images successively on a plurality of pieces of recording media. The printing apparatus includes at least two platens including a first platen to hold a first recording medium and a second platen to hold a second recording medium, at least one print head, which is driven according to print data to eject ink onto the first recording medium and the second recording medium, at least one print head drive unit to drive the at least one print head in a main scanning direction, at least two platen drive units to drive each of the at least two platens including a first platen drive unit to drive the first platen in an auxiliary direction, which is perpendicular to the main scanning direction, and a second platen drive unit to drive the second platen in the auxiliary direction, at least one ink cartridge to store ink therein and supply the ink to the at least one print head, at least two operation input units to be operated by an operator to instruct the printing apparatus to activate printing processes, including a first operation input unit to instruct a first printing process to form an image on the first recording medium by activating the at least one print head, the at least one print head drive unit, and the first platen drive unit and a second operation input unit to instruct a second printing process to form an image on the second recording medium by activating the at least one print head, the at least one print head drive unit, and the second platen drive unit, and a cooperation controller system to control the at least one print head, the at least one print head drive unit, the first platen drive unit, and the second platen drive unit to behave in cooperation with one another so that the second printing process is started one of after completion of the first printing process and during the first printing process when an instruction to start the second printing process is entered through the second operation input unit whilst the first printing process is in progress.

With the printing apparatus according to the above configuration, the second printing operation can be reserved so that the second printing operation can be started efficiently after completion of the first printing process or during the first printing process. Thus, the operator is not required to stand by the printing apparatus and await the first printing process to be completed, and operation efficiency of the operator can be improved.

BRIEF DESCRIPTION OF THE ACCOMPANYING DRAWINGS

DETAILED DESCRIPTION

Hereinafter, an embodiment according to an aspect of the present invention will be described with reference to the accompanying drawings.

Figure 1:
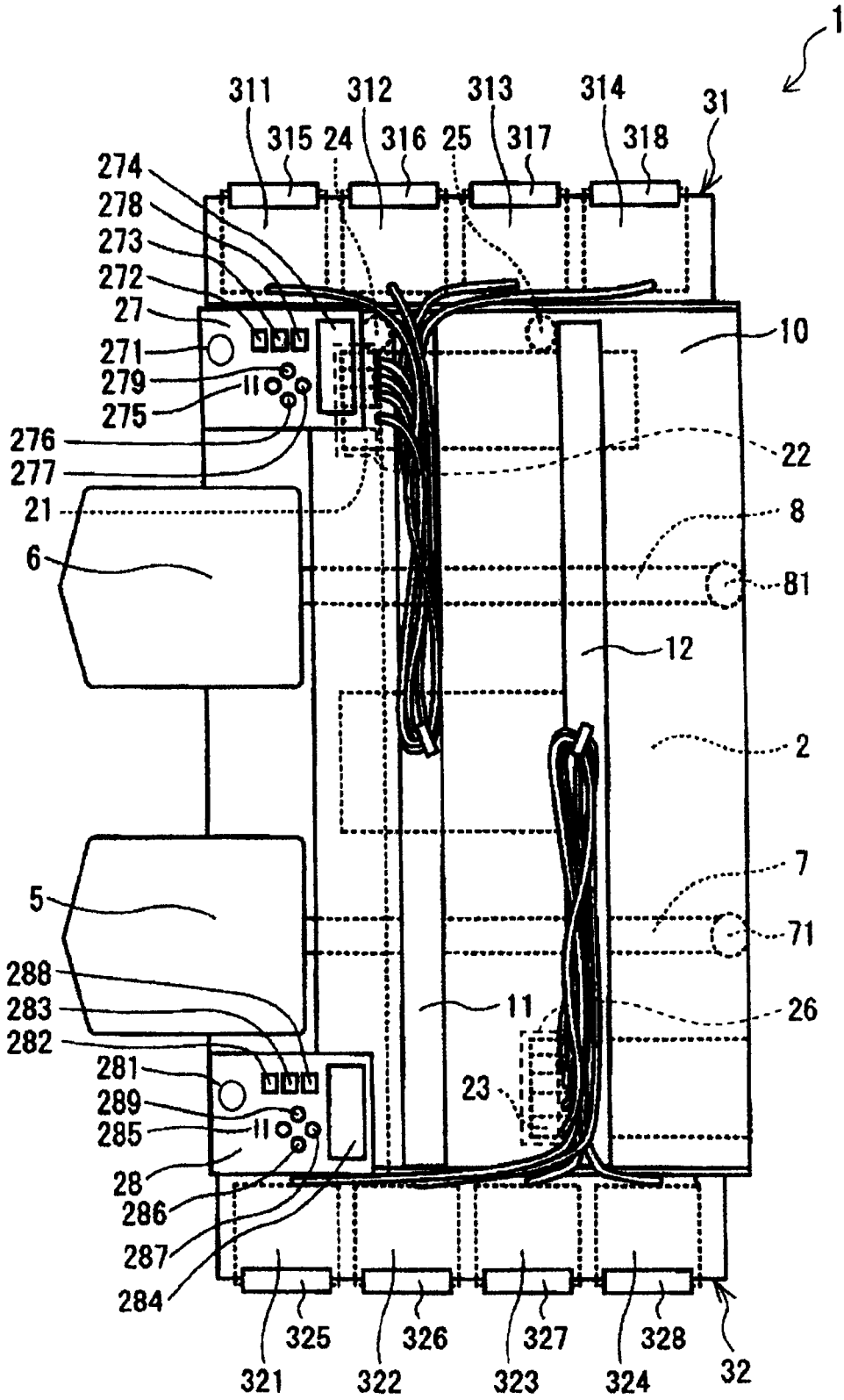
FIG. 1 is a top plane view of an inkjet printer according to an embodiment of the present invention.
Figure 2:
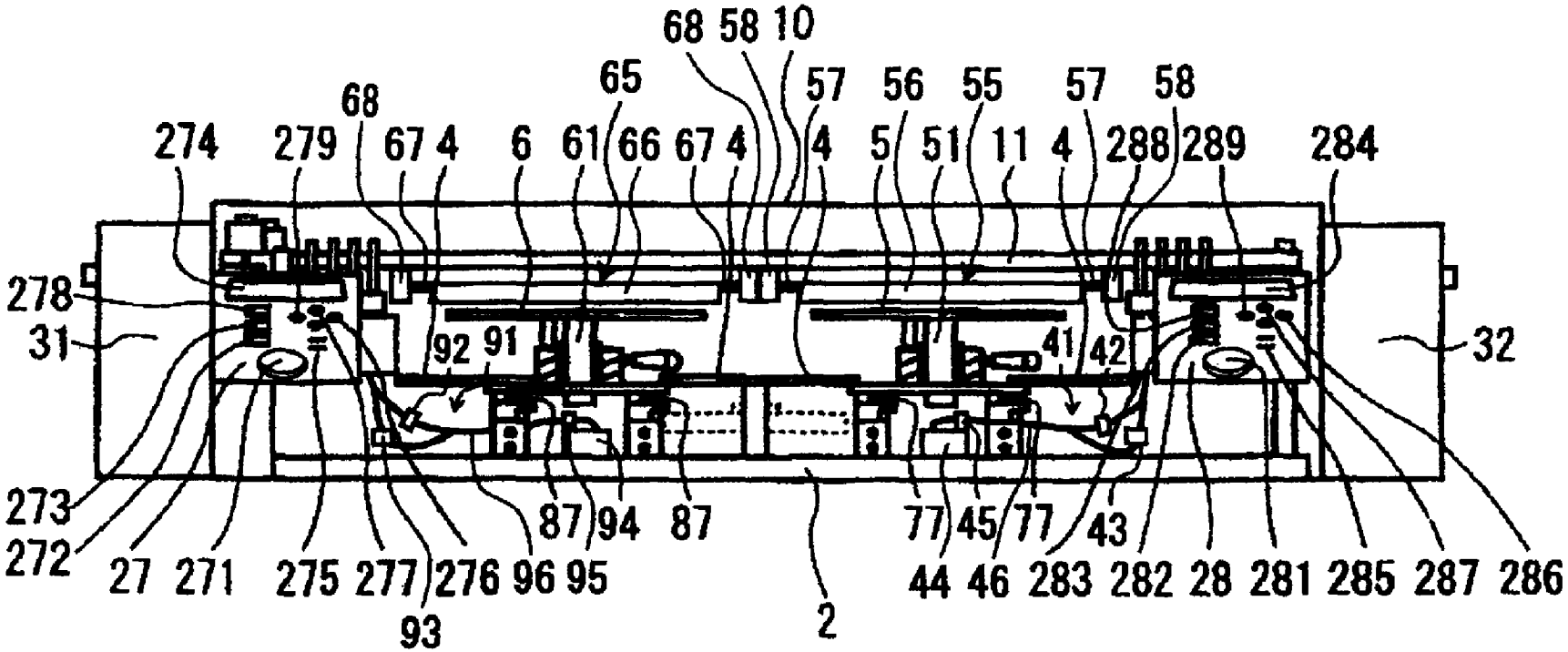
FIG. 2 is a front view of the inkjet printer according to the embodiment of the present invention.
Figure 3:
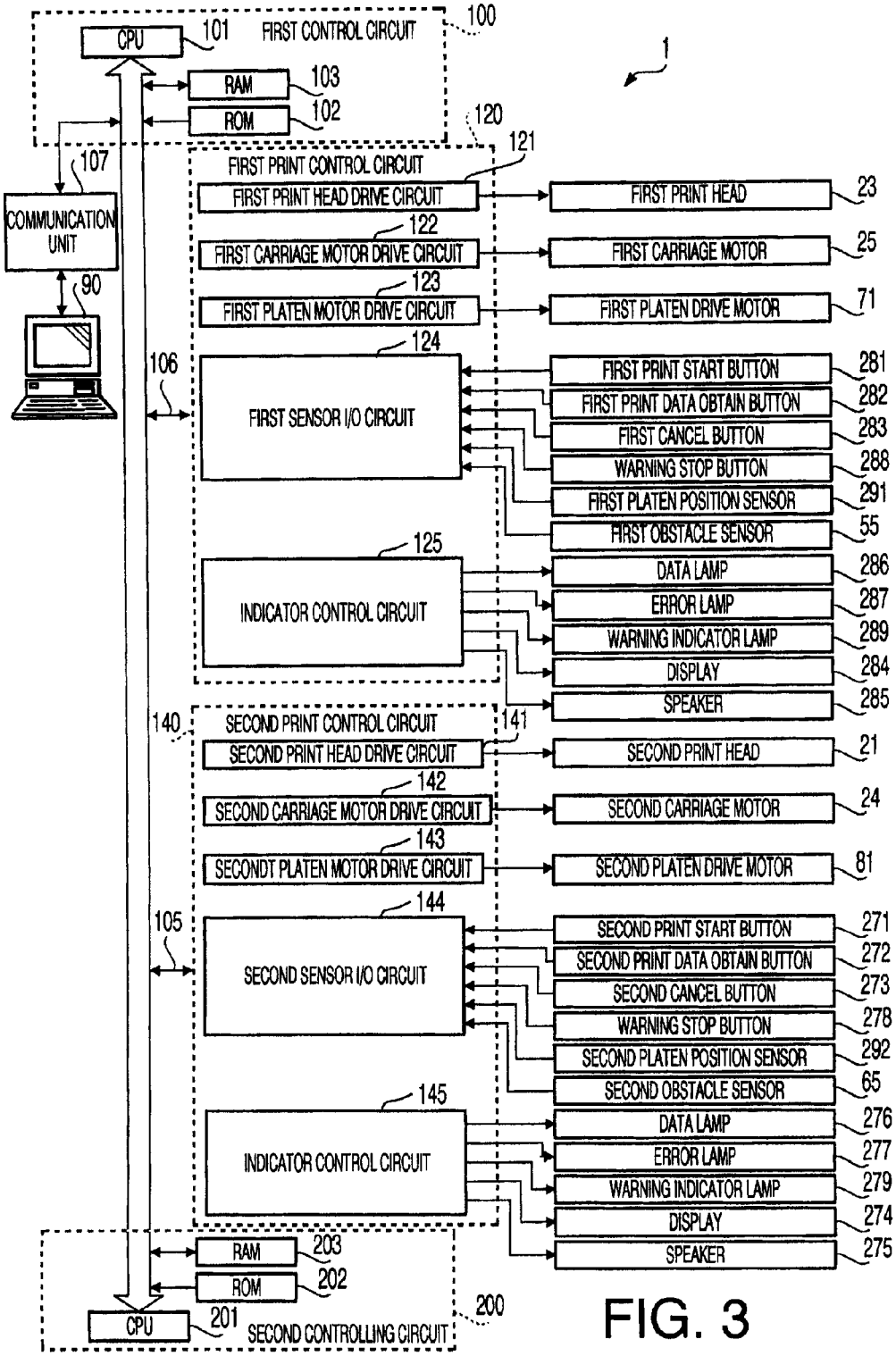
FIG. 3 is a block diagram to illustrate an electrical configuration of the inkjet printer according to the embodiment of the present invention.

An inkjet printer 1 according to the embodiment of the present invention will be described with reference to FIGS. 1 through 3. FIG. 1 is a top plane view of the inkjet printer 1 according to the embodiment of the present invention. FIG. 2 is a front view of the inkjet printer 1 according to the embodiment of the present invention. FIG. 3 is a block diagram to illustrate an electrical configuration of the inkjet printer 1 according to the embodiment of the present invention.

The inkjet printer 1 according to the present embodiment is an inkjet printer having a first print head 23 to eject opaque white (W) ink onto a recording medium and a second print head 21, from which inks in colors of cyan (C), magenta (M), yellow (Y), and black (K) are ejected onto the recording medium. The recording medium in the present embodiment is a piece of fabric, more specifically a T-shirt, and an image according to image data inputted in the inkjet printer 1 from an external data processing apparatus is formed on the T-shirt. As shown in FIGS. 1 and 2, the inkjet printer 1 is provided with a flat base 2 at a bottom thereof and a casing 10 to cover an entire configuration of the inkjet printer 1.

In the present embodiment, a left-hand side which appears in FIG. 1 is referred to as the front side of the inkjet printer 1. Further, an upper side in FIG. 1 and a left-hand side in FIG. 2 correspond to the left end of the inkjet printer 1. Accordingly, a lower side in FIG. 1 and a right-hand side in FIG. 2 correspond to the right end of the inkjet printer 1. In addition, a direction, in which a first carriage 26 with the first the first print head 23 mounted thereon and a second carriage 22 with the second print heads 21 mounted thereon are reciprocated, corresponds to a main scanning direction (i.e., a vertical direction in FIG. 1) of the print heads 21, 23.

Inside the casing 10, the inkjet printer 1 is provided with an inkjet printing mechanism, which includes the first print head 23, the first carriage 26, and a guide rail 12. The guide rail 12 is arranged in parallel with the main scanning direction to guide the carriage 26 with the print head 23 there-along. Further, a first carriage motor 25, a pulley (not shown), and a carriage belt (not shown) are provided. The first carriage motor 25 is in vicinity to one end (an upper end in FIG. 1 in the present embodiment) of the guide rail 12, and the pulley is in vicinity to the other end (a lower end in FIG. 1). The carriage belt is provided to connect the first carriage motor 25 and the pulley. The carriage belt is fixed to a rear side of the first carriage 26 so that the first carriage 26 can be reciprocated along the guide rail 12 as the carriage belt is driven by the first carriage motor 25.

The inkjet printer 1 is further provided with a purging unit 41 for the first print head 23 on the right-hand end of the guide rail 12. The purging unit 41 includes, as shown in FIG. 2, a suction cap (not shown) which can be closely attached to and separated from a nozzle surface of the first print head 23, a valve 42 to adjust air pressure in the suction cap, a suction pump 43 to aspirate ink in the nozzles, a waste ink tank 44 to store the aspirated ink, a waste ink valve 45 to control flows of the ink to the waste ink tank 44, and tubes 46 to connect the above components. The valve 42 is opened to release air immediately before the suction cap becomes in contact with the first print head 23 and closed when the suction cap becomes in contact with the first print head 23. The valve 42 is again opened before the suction cap is separated from the first print head 23. Thus, air pressure in the suction cap is adjusted so that generation of air bubbles in the ink in the suction cap can be prevented. When the suction cap is in contact with the first print head 23, the suction pump 43 can be activated in order to aspirate and remove ink containing air bubbles from the nozzle surface of the first print head 23.

Further inside the casing 10, the inkjet printer 1 is provided with a guide rail 11, which is arranged in parallel with the main scanning direction to guide a second carriage 22 with the print head 21 there-along. Furthermore, a second carriage motor 24, a pulley (not shown), and a carriage belt (not shown) are provided. The second carriage motor 24 is in vicinity to one end (an upper end in FIG. 1 in the present embodiment) of the guide rail 11, and the pulley is in vicinity to the other end (a lower end in FIG. 1). The carriage belt is provided to connect the second carriage motor 24 and the pulley. The carriage belt is fixed to a rear side of the second carriage 22 so that the second carriage 22 can be reciprocated along the guide rail 11 as the carriage belt is driven by the second carriage motor 24.

On the left-hand side of the guide rail 11, as shown in FIG. 2, a purging unit 91 for the second print head 21, which is in a similar configuration to the purging unit 41, to aspirate ink containing air bubbles from a nozzle surface of the second print head 21 is provided. The purging unit 91 includes a suction cap (not shown), a valve 92, a suction pump 93, a waste tank 94, and a waste ink valve 95, and tubes 96.

Next, platens of the inkjet printer 1 according to the present embodiment to hold the recording medium will de described. The inkjet printer 1 is provided with a pair of platens, a first platen 5 and a second platen 6, which are identical to each other. The first platen 5 and the second platen 6 are movable in parallel with an auxiliary scanning direction, which is substantially perpendicular to the main scanning direction of the print head 21 (i.e., a horizontal direction in FIG. 1).

In order to drive the platens 5, 6, in the auxiliary direction respectively, the inkjet printer 1 is provided with a first drive mechanism 7 and a second drive mechanism 8, which are arranged in parallel with each other. The first drive mechanism 7 is to drive the first platen 5 and includes guide rails 77, 77 (see FIG. 2) and a first platen drive motor 71. The first platen drive motor 71, which is a stepping motor in the present embodiment, is arranged on one end (a right-hand end in FIG. 1) of each of the guide rails 77, 77. The first platen drive motor 71 is arranged in vicinity to a rear end (the right-hand end in FIG. 1) in the casing 10. As the first platen drive motor 71 is activated, the first platen 5 is reciprocated in the auxiliary direction along the guide rails 77, 77.

Similarly, the second drive mechanism 8 is provided to drive the second platen 6 and includes guide rails 87, 87 (see FIG. 2) and a second platen drive motor 81, which is a stepping motor. The second platen 6 is reciprocated in the auxiliary direction along the guide rails 87, 87 as the second platen drive motor 81 is activated. The second platen drive motor 81 is arranged in vicinity to the rear end (the right-hand end in FIG. 1) in the casing 10.

Each of the first platen 5 and the second platen 6 is formed to have a pentagonal shape in a plane view. More specifically, a front end of each platen is formed in an obtuse V-like shape protruding toward the front of the inkjet printer 1 so that the recording medium (i.e., a T-shirt in the present embodiment)

can be placed horizontally over a top surface of the platen. In the present embodiment, hereinafter, a recording medium (i.e., a piece of fabric in the present embodiment) being set over the first platen 5 is referred to as a first recording medium, and a recording medium being set over the second platen 6 is referred to as a second recording medium.

The inkjet printer 1 is further provided with a first obstacle sensor 55 and a second obstacle sensor 65 on the front side (left-hand side in FIG. 1) with respect to the guide rail 11 above the first platen 5 and the second platen 6 respectively. The first obstacle sensor 55 and the second obstacle sensor 65 detect height of objects (i.e., the recording media) on the first and the second platens 5, 6 respectively. The first obstacle sensor 55 includes a sensing plate 56, shafts 57, 57, and shaft supports 58, 58. The sensing plate 56, extending in the main scanning direction, is positioned in the first obstacle sensor 55 to have a predetermined clearance between a lower end thereof and a top surface of the platen 5. The sensing plate 56 is fixed to the shafts 57, 57, which are rotatably supported by the shaft supports 58, 58 respectively. The second obstacle sensor 65 is in a similar configuration to the first obstacle sensor 55 and includes a sensing plate 66, shafts 67, 67, and shaft supports 68, 68. When the pieces of fabric placed over the first and the second platens 5, 6 have creases which are higher than the predetermined height, the creases become in contact with the lower ends of the sensing plates 56, 66 while the pieces of fabric are fed in the inkjet printer 1. Accordingly, the sensing plates 56, 66 are rotated by the creases so that the creases are detected. When the sensing plates 56, 66 are rotated, presence of the obstacles is notified to the operator in a known error indicating method, such as by a warning sound.

Furthermore, as shown in FIG. 2, trays 4, 4, 4, 4 having surfaces which are substantially parallel with the top surfaces of the first and the second platens 5, 6 are provided at positions below the first and the second platens 5, 6. The trays 4, 4, 4, 4 are arranged below each side of the first and the second platens 5, 6 and fixed to the first and the second platens 5, 6 respectively so that the trays 4, 4, 4, 4 are moved along with the first and the second platens 5, 6. The trays 4, 4, 4, 4 are provided to receive overhanging portions of the recording medium such as sleeves of the T-shirt, which are not held by the platens 5, 6, so that the trays 4, 4, 4, 4 can prevent the overhanging portions from interfering the base 2 when the T-shirts are installed on the first platen 5 and the second platen 6.

The inkjet printer 1 is provided with a first ink cartridge storage unit 32, in which ink cartridges 231, 222, 323, 324 are stored, on the right-hand side in the casing 10, as shown in FIG. 2. The ink cartridges 231, 222, 323, 324, containing white ink, are fixed in the first ink cartridge storage unit 32 by fixing members 325, 326, 327, 328 respectively. The inkjet printer 1 is further provided with a second ink cartridge storage unit 31, in which ink cartridges 311, 312, 313, 314 are stored, on the left-hand side in the casing 10, as shown in FIG. 2. The ink cartridges 311, 312, 313, 314, containing C, M, Y, K inks respectively, are fixed in the second ink cartridge storage unit 31 by fixing members 315, 316, 317, 318 respectively. The ink cartridges 231, 222, 323, 324 and 311, 312, 313, 314 are connected to the first and the second print heads 23, 21 respectively through ink supplying tubes (not shown).

As shown in FIGS. 1 and 2, the inkjet printer 1 is further provided with a first operation panel 28 on the right-hand side of the front thereof. The first operation panel 28 includes a plurality of operation buttons, through which a user's operations to manipulate the first platen 5, the first or the second print head 23 (21), and the first or the second carriage 26 (22) are inputted, such as a first print start button 281 to instruct printing on the fabric placed on the first platen 5 and a first cancel button 283 to instruct cancellation of the printing instruction. Further, the first operation panel 28 includes a display 284 (an LCD (liquid crystal display) in the present embodiment) to display various information concerning the operation, a first print data obtain button 282 to instruct obtainment of print data, a data lamp 286 to indicate reception of the print data, and an error lamp 287 to indicate an operation error. The first operation panel 28 further includes a speaker 285 to generate a warning sound.

Also as shown in FIGS. 1 and 2, the inkjet printer 1 is provided with a second operation panel 27 on the left-hand side of the front thereof. The second operation panel 27 includes a plurality of operation buttons, through which a user's operations to manipulate the second platen 6, the second or the first print head 21 (23), and the second or the first carriage 22 (26) are inputted, such as a second print start button 271 to instruct printing on the fabric placed on the second platen 6 and a second cancel button 273 to instruct cancellation of the printing instruction. Further, the second operation panel 27 includes a display 274 (an LCD in the present embodiment) to display various information concerning the operation, a second print data obtain button 272 to instruct obtainment of print data, a data lamp 276 to indicate reception of the print data, and an error lamp 277 to indicate an operation error. The second operation panel 27 also includes a speaker 275 to generate a warning sound.

Next, referring to FIG. 3, an electrical configuration of the inkjet printer 1 according to the present embodiment will be described. FIG. 3 is a block diagram to illustrate the electrical configuration of the inkjet printer 1 according to the embodiment of the present invention. The inkjet printer 1 includes a first controlling circuit 100, a second controlling circuit 200, a first print control circuit 120, and a second print control circuit 140.

The first controlling circuit 100 is a circuit to control a printing operation to print an image on the fabric supported by the first platen 5, including driving the first platen 5, the first and the second carriages 26, 22. The first controlling circuit 100 is provided within the first operation panel 28 and includes a CPU 101, a ROM 102 to store various controlling programs to be executed by the CPU 101, and a RAM 103 to temporarily store various data. The second controlling circuit 200 is a circuit to control a printing operation to print an image on the fabric supported by the second platen 6, including driving the second platen 6, the second and the first carriages 22, 26. The second controlling circuit 140 is provided within the second operation panel 27 and includes a CPU 201, a ROM 202, and a RAM 203, similarly to the first controlling circuit 100. The first controlling circuit 100 and the second controlling circuit 200 are connected to each other through an interface 104 (e.g., LVDS (low voltage differential signaling)) to exchange information therebetween and share various information necessary to control the operations. Further, the first and the second controlling circuits 100, 200 are connected with the first print control circuit 120 and the second print control circuit 140 through the interface 104 and buses 105, 106 respectively. Furthermore, the first and the second controlling circuits 100, 200 are connected with a PC (personal computer) 90, in which print data is generated, via a communication unit 107.

The first print control circuit 120 is a circuit to control behaviors of the first platen 5, the first print head 23, and the first carriage 26 and includes a first print head drive circuit 121, a first carriage motor drive circuit 122, and a first platen motor drive circuit 123. The first print head drive circuit 121 is to activate and inactivate piezoelectric actuators in each channel in the first print head 23. The first carriage motor drive circuit 122 is to activate and inactivate the first carriage motor 25, and the first platen motor drive circuit 123 is to activate and inactivate the first platen drive motor 71. The first print control circuit 120 further includes a first sensor I/O circuit 124 and an indicator control circuit 125. The first sensor I/O circuit 124 accepts information inputted by the first print start button 281, the first print data obtain button 282, the first cancel button 283, a warning stop button 288 to stop the warning sound from the speaker 285, a first platen position sensor 291, which is to detect a position of the first platen 5, and the first obstacle sensor 55. The indicator control circuit 125 controls the data lamp 286, the error lamp 287, a warning indicator lamp 289, which indicates the warning stop button 288 needs to be operated, the display 284, and the speaker 285.

The second print control circuit 140 is a circuit to control behaviors of the second platen 6, the second print head 21, and the second carriage 22 and includes a second print head drive circuit 141, a second carriage motor drive circuit 142, and a second platen motor drive circuit 143. The second print head drive circuit 141 is to activate and inactivate piezoelectric actuators in each channel in the second print head 21. The second carriage motor drive circuit 142 is to activate and inactivate the second carriage motor 24, and the second platen motor drive circuit 143 is to activate and inactivate the second platen drive motor 81. The second print control circuit 140 further includes a second sensor I/O circuit 144 and an indicator control circuit 145. The second sensor I/O circuit 144 accepts information inputted by the second print start button 271, the second print data obtain button 272, the second cancel button 273, a warning stop button 278 to stop the warning sound from the speaker 275, a second platen position sensor 292, which is to detect a position of the second platen 6, and the second obstacle sensor 65. The indicator control circuit 145 controls the data lamp 276, the error lamp 277, a warning indicator lamp 279, which indicates the warning stop button 278 needs to be operated, the display 274, and the speaker 275.

Figure 4:
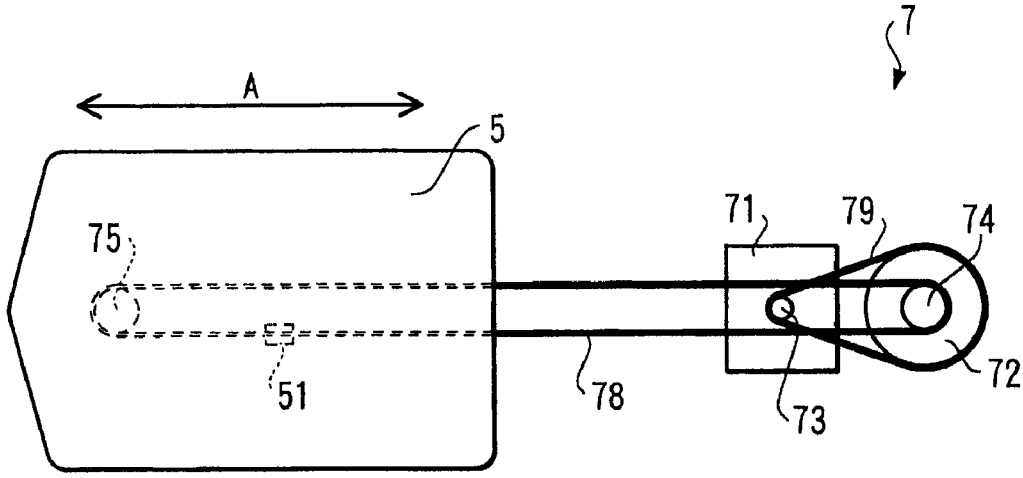
FIG. 4 is an illustrative top view of a drive mechanism of a platen according to the embodiment of the present invention.
Figure 5:
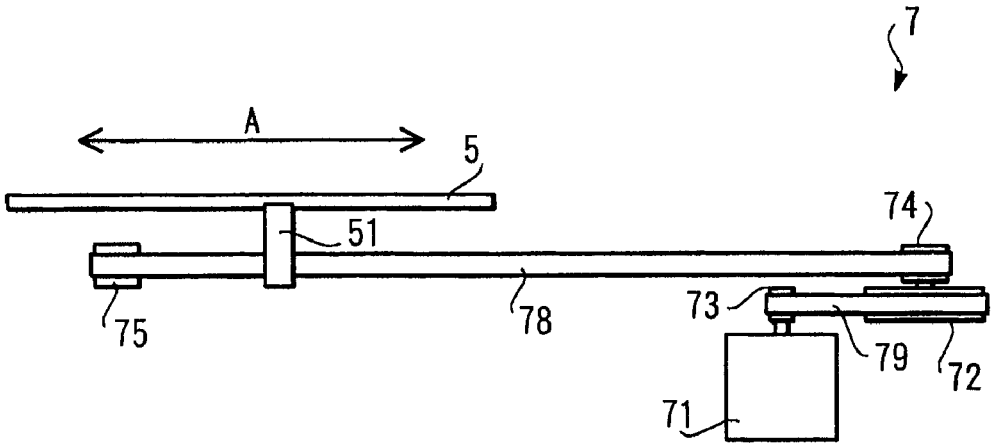
FIG. 5 is an illustrative side view of the drive mechanism of the platen according to the embodiment of the present invention.

Next, referring to FIGS. 4 and 5, the first drive mechanism 7 to drive the first platen 5 will be described. FIG. 4 is an illustrative top view of the first drive mechanism 7 according to the embodiment of the present invention. FIG. 5 is an illustrative side view of the first drive mechanism according to the embodiment of the present invention. The left-hand side which appears in FIGS. 4 and 5 corresponds to the front of the inkjet printer 1, and the right-hand side which appears in FIGS. 4 and 5 corresponds to the rear of the inkjet printer 1.

The first drive mechanism 7 is provided with a motor pulley 73, a greater pulley 72, and a motor belt 79, and the motor belt 79 encircles the motor pulley 73 and the greater pulley 72. As the first platen drive motor 71 rotates, the motor pulley 73 is rotated, and the greater pulley 72 is rotated accordingly. The first drive mechanism 7 is provided with a first belt pulley 74, which is attached to the greater pulley 72 to rotate coaxially and in synchronization with the greater pulley 72. The first platen drive motor 71, the motor pulley 73, the greater pulley 72, and the first belt pulley 74 are arranged in the casing 10 in positions lower than a horizontal plane on which the first platen 5 is shifted. Further, a timing belt 78 is provided to encircle the first belt pulley 74 and a second belt pulley 75. The second belt pulley 75 is provided in a position closer to the front of the inkjet printer 1 (i.e., on the left-hand side in FIGS. 1, 4, and 5). A diameter of the second belt pulley 75 is substantially equivalent to a diameter of the first belt pulley 74.

In the inkjet printer 1, the first belt pulley 74 and the second belt pulley 75 are arranged in positions such that a line connecting a rotation axis of the first belt pulley 74 and a center of the second belt pulley 75 is perpendicular to the main scanning direction of the first print head 23 (i.e., an axial direction of the guide rail 12), and the timing belt 78 is oriented perpendicularly to the main scanning direction of the first print head 23. The timing belt 78 is fixed to the first platen 5 by a platen attachment 51 so that the first platen 5 is shifted in a direction indicated by an arrow A in FIGS. 4 and 5 (i.e., the auxiliary scanning direction and a front-rear direction of the inkjet printer 1) as the timing belt 78 is shifted in accordance with rotation of the first belt pulley 74. Thus, rotation of the first platen drive motor 71 is conveyed to the motor pulley 73, the motor belt 79, the greater pulley 72, the first belt pulley 74, the timing belt 78, the second belt pulley 75, and the platen attachment 51, and thus converted into horizontal movement to shift the first platen 5 in the auxiliary direction.

The second drive mechanism 8 is in a similar configuration to the configuration of the first drive mechanism 7, and description of that is herein omitted.

Figure 6:
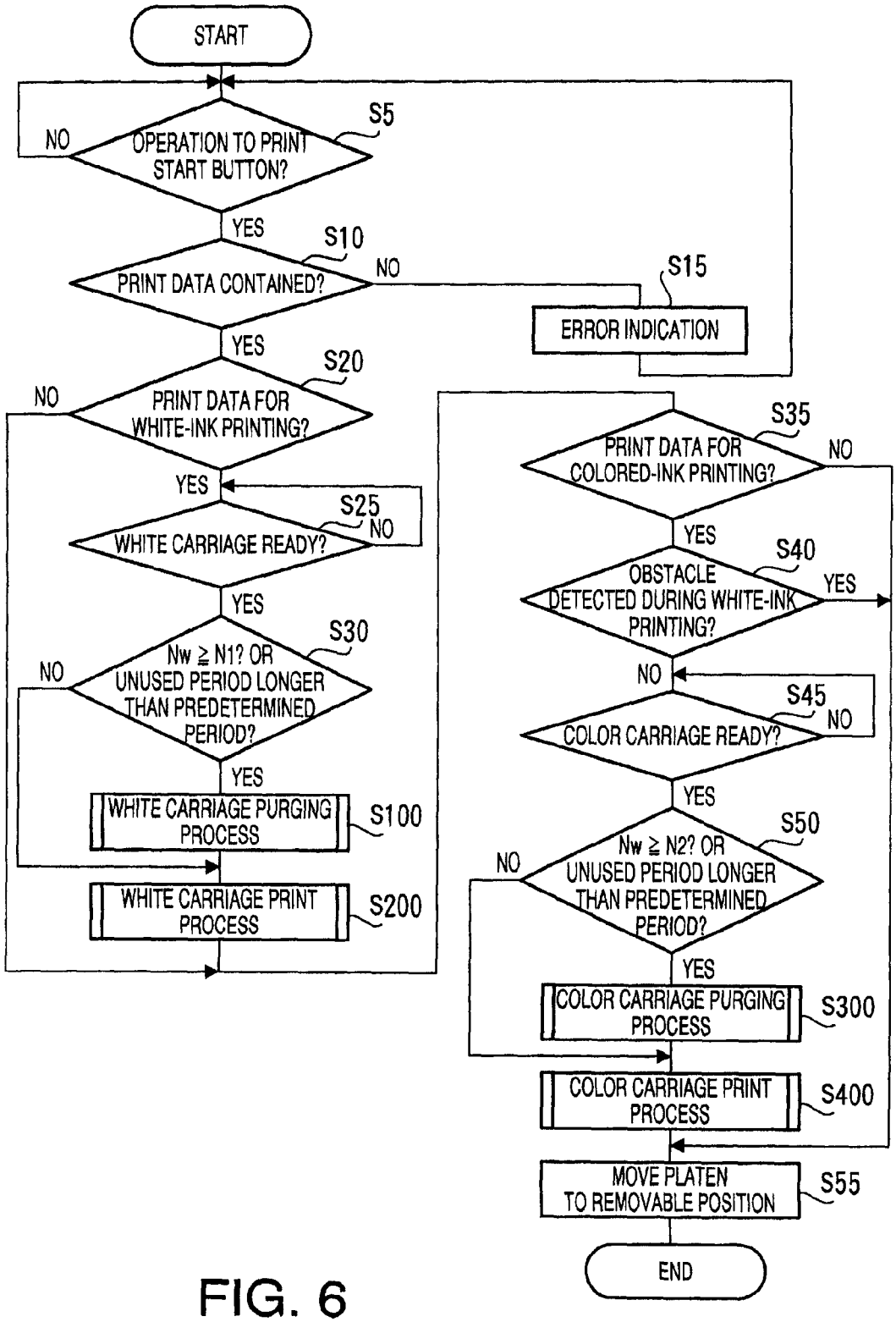
FIG. 6 is a flowchart to illustrate a print controlling operation executed by CPUs in a first and a second controlling circuits according to the embodiment of the present invention.
Figure 7:
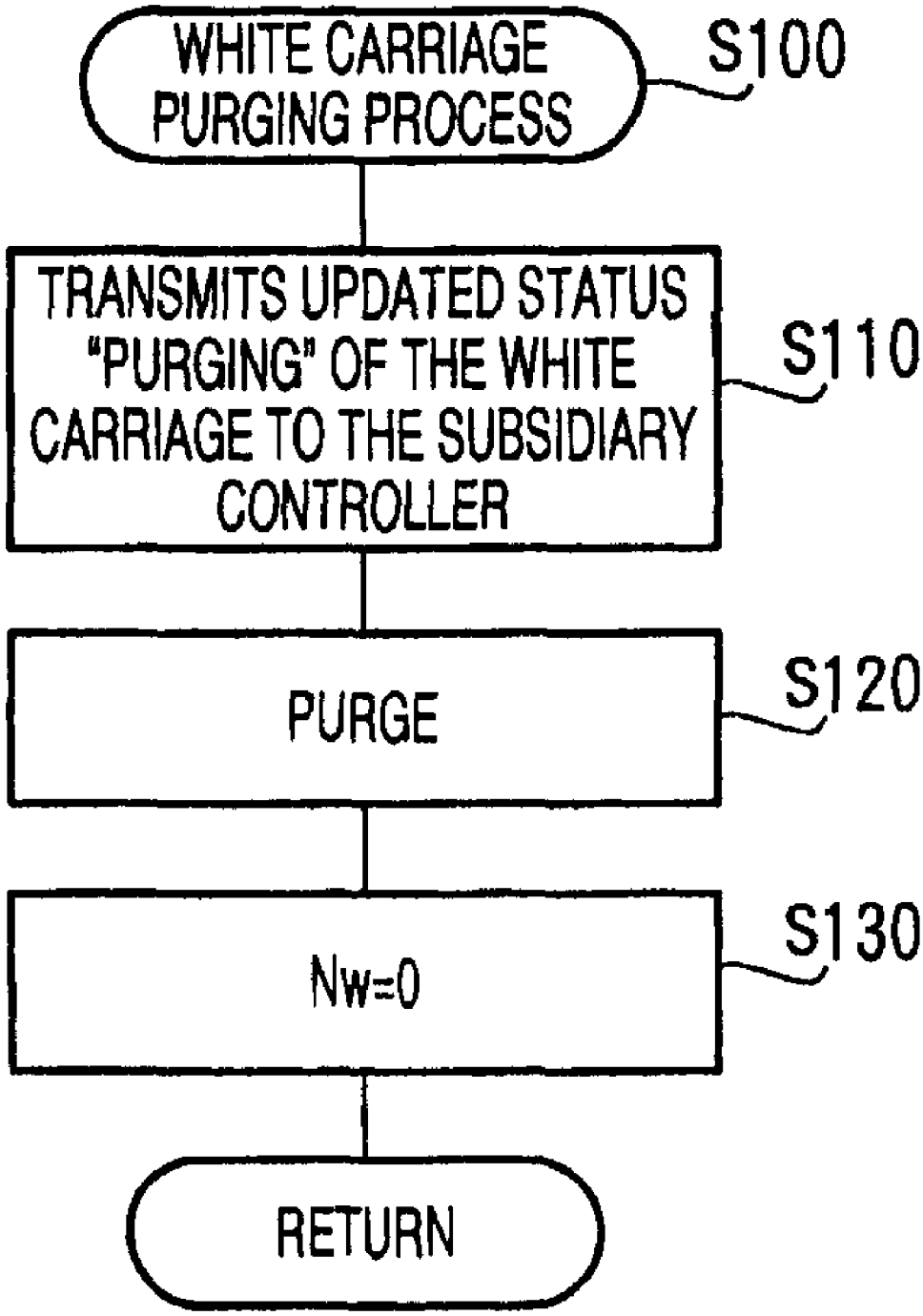
FIG. 7 is a flowchart to illustrate a white carriage purging process to be executed in the inkjet printer according to the embodiment of the present invention.
Figure 8:
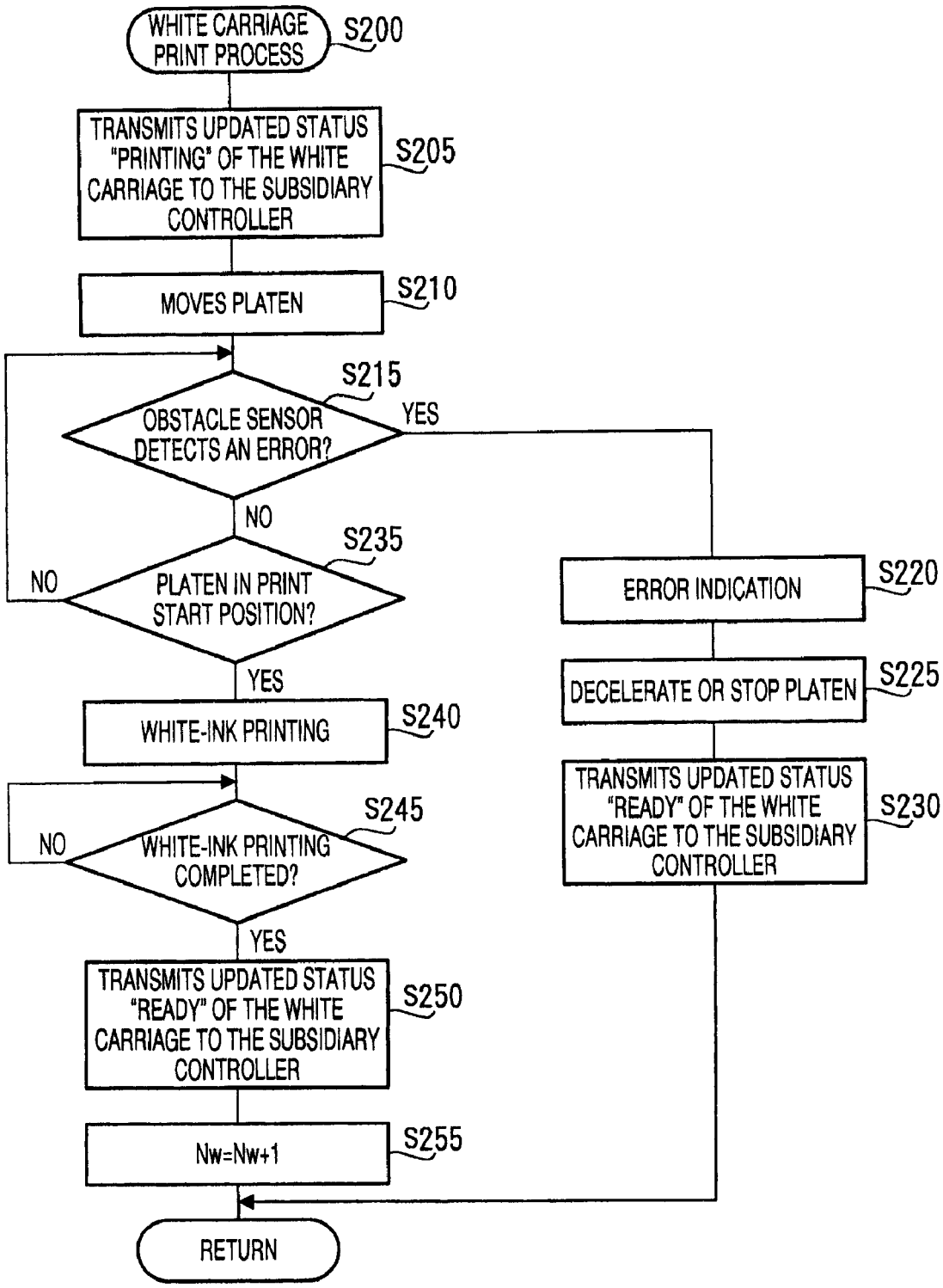
FIG. 8 is a flowchart to illustrate a white carriage printing process to be executed in the inkjet printer according to the embodiment of the present invention.
Figure 9:
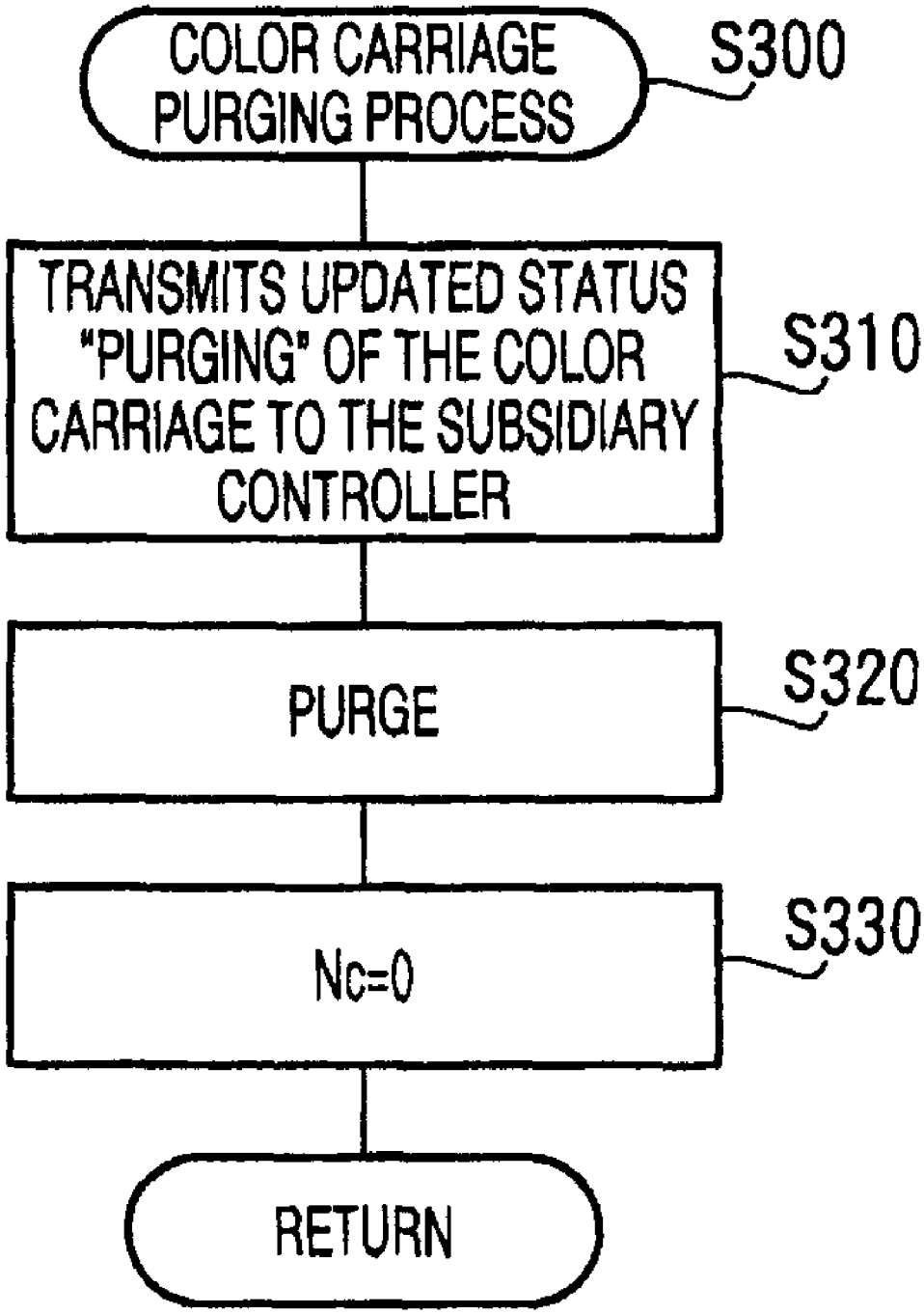
FIG. 9 is a flowchart to illustrate a color carriage purging process to be executed in the inkjet printer according to the embodiment of the present invention.
Figure 10:
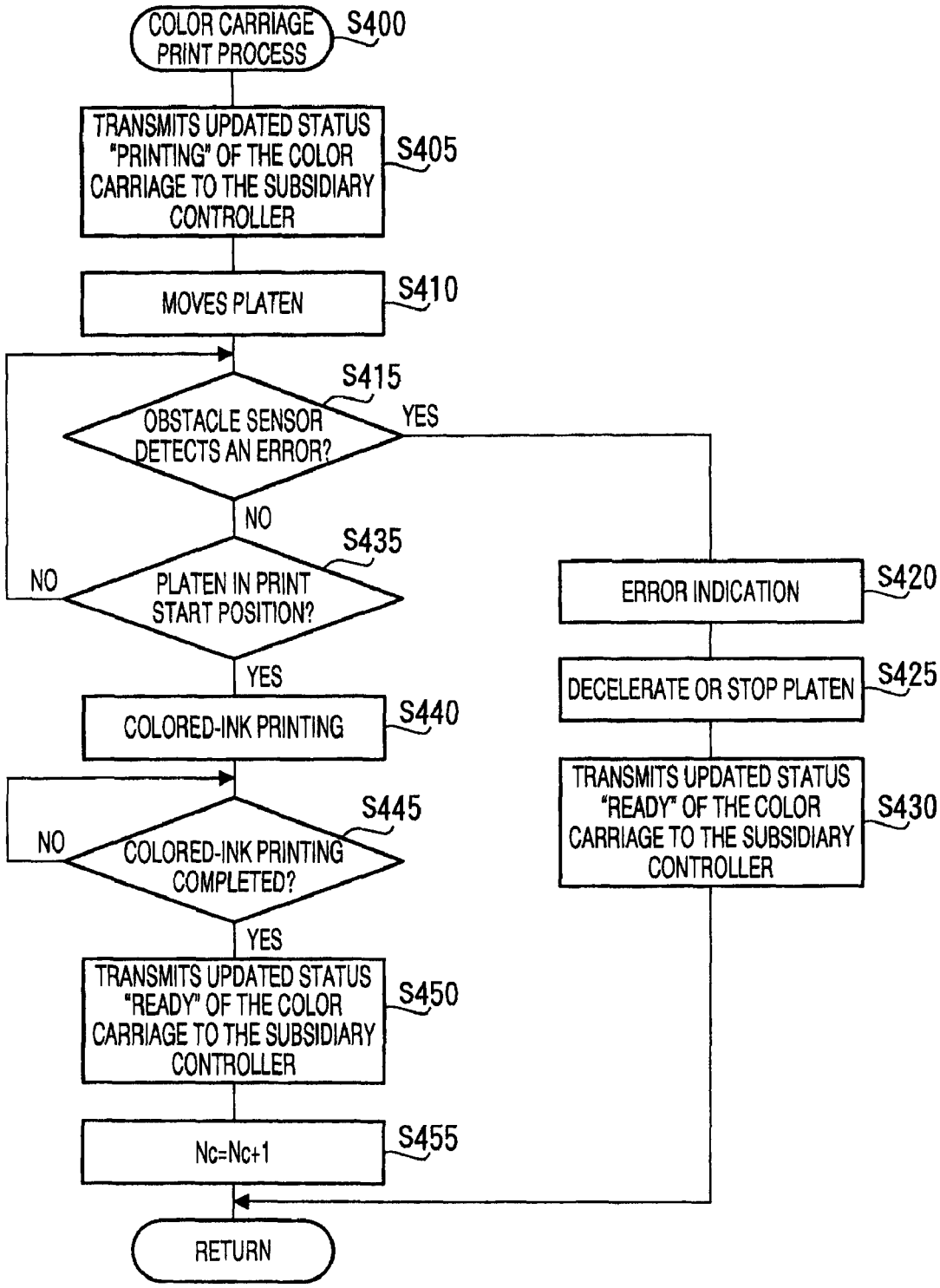
FIG. 10 is a flowchart to illustrate a color carriage printing process to be executed in the inkjet printer according to the embodiment of the present invention.

Next, with reference to FIGS. 6 through 10, control flows of a printing operation in the inkjet printer 1 according to the embodiment of the present invention will be described. FIG. 6 is a flowchart to illustrate a print controlling operation executed by the CPU 101 in the first controlling circuit 100 and the CPU 201 of the second controlling circuit 200 according to the embodiment of the present invention. FIG. 7 is a flowchart to illustrate a white carriage purging process to be executed in the inkjet printer 1 according to the embodiment of the present invention. FIG. 8 is a flowchart to illustrate a white carriage printing process to be executed in the inkjet printer 1 according to the embodiment of the present invention. FIG. 9 is a flowchart to illustrate a color carriage purging process to be executed in the inkjet printer 1 according to the embodiment of the present invention. FIG. 10 is a flowchart to illustrate a color carriage printing process to be executed in the inkjet printer 1 according to the embodiment of the present invention. Controlling programs for the above processes are stored in the ROM 02 of the first controlling circuit 100 and the ROM 202 of the second controlling circuit 200 and executed in parallel by the CPU 101 and the CPU 201.

In the description below and FIGS. 6-10, the white carriage refers to the first carriage 26 with the first print head 23 for white ink being mounted, and the color carriage refers to the second carriage 22 with the second print head 21 for CMYK inks being mounted. Further, in the description below and FIGS. 7-10, when one of the CPUs 101, 201 of the first and the second controlling circuits 100, 200 is working as a main controller, the other one of the CPUs 101, 201 is referred to as a subsidiary controller. Namely, when the CPU 101 of the first controlling circuit 100 is working as a main controller, the CPU 201 of the second controlling circuit 200 is the subsidiary controller, and vice versa. In the present embodiment hereinbelow, the CPU 101 is referred to as the main controller, and the CPU 201 is the subsidiary controller.

When the print controlling operation starts, as shown in FIG. 6, in S5, the CPU 101 examines as to whether the first print start button 281 has been operated. The judgment is made based on input signals from the first sensor I/O circuit 124 of the first print control circuit 120. When an operation to the first print start button 281 is detected (S5: YES), the CPU 101 proceeds to S10.

In S10, the CPU 101 examines as to whether the RAM 103 of the first controlling circuit 100 contains print data representing an image to be formed. When the print data is not contained (S10: NO), in S15, the CPU 101 transmits error signals to the indicator control circuits 125 of the first print control circuit 120 so that the user can be notified of an error, for example, by a warning sound from the speaker 285. In S10, if the print data is contained in the RAM 103 (S10: YES), the CPU 101 proceeds to S20.

In S20, the CPU 101 examines as to whether the print data contained in the RAM 103 is data to form the image in the white ink by driving the first print head 23. If the print data does not represent the image to be formed in the white ink (S20: NO), the CPU 101 proceeds to S35. If the print data represents the image to be formed in the white ink (S20: YES), the CPU 101 proceeds to S25.

In S25, the CPU 101 examines as to whether the white carriage, i.e., the first carriage 26, is ready for the print data. If the first carriage 26 is not ready (S25: NO), the CPU 101 repeats S25 until the first carriage 26 becomes ready. When the first carriage 26 is ready (S25: YES), the CPU 101 proceeds to S30. In the present embodiment, status of the first and the second carriages 26, 22 includes "purging," in which the first or the second carriage 26, 22 is being purged, "printing," in which image forming is in progress, and "ready." When the first or the second carriage 26, 22 is in neither of "purging" nor "printing," the status of the first or the second carriage 26, 22 is referred to as "ready."

In S30, the CPU 101 examines as to whether a variable Nw, which indicates a number of printing operations conducted by the first carriage 26 after a latest purging process, is greater than or equal to a predetermined number N1. Further, the CPU 101 examines as to whether a predetermined time period has elapsed after a latest printing operation conducted by the first carriage 26. If the variable Nw indicates smaller than the predetermined number N1, and the first carriage 26 has been maintained unused for a shorter time period than the predetermined time period (S30: NO), the CPU 101 proceeds to S200. If the variable Nw is greater than or equal to the predetermined number N1 (S30: YES), or the time period in which the first carriage 26 has been maintained unused is longer than or equal to the predetermined time period (S30: YES), the CPU 101 proceeds to S100.

In S100, the CPU 101 executes a white carriage purging process, in which the nozzle surface of the first print head 23 being mounted on the first carriage 26 is purged so that ink remaining in the nozzle surface can be removed. The white carriage purging process will be described hereinbelow with reference to FIG. 7.

When the white carriage purging process starts, in S110, the CPU 101 updates the status of the first carriage 26 to "purging" and transmits the status information to the subsidiary controller (i.e., the CPU 201 of the second controlling circuit 200) through the interface 104.

In S120, the CPU 101 executes a purging process, in which the nozzle surface of the first print head 23 is purged to remove air bubbles in the ink on the nozzle surface. More specifically, the waste valve 45 is released to open an ink path in the tube 46 to the waste tank 44. Further, the first carriage motor 25 is activated, and the first carriage 26 is moved to a predetermined purging position. Next, the valve 42 is released to open the ink path in the tube 46 to the aspiration cap. The aspiration cap is raised to the first print head 23, and the valve 42 is closed when the aspiration cap covers the nozzle surface of the first print head 23. The aspiration pump 43 is activated so that the ink remaining in the nozzle surface of the first print head 23 containing air bubbles is removed therefrom. The aspirated ink is transported through the waste ink valve 45 to the waste tank 44. The valve 42 is again released, and the aspiration cap is separated from the first print head 23.

In S130, the CPU 101 initializes the variable Nw to zero and updates an origin of time period to measure the unused time period of the first carriage 26 to the time in which the current purging operation was conducted. The CPU 101 returns to S100 in FIG. 6.

Following S100, in S200, the CPU 101 executes a white carriage print process, in which the image is formed by driving the first print head 23 being mounted on the first carriage 26. The white carriage print process will be described hereinbelow with reference to FIG. 8.

When the white carriage print process starts, in S205, the CPU 101 updates the status of the first carriage 26 to "printing" and transmits the status information to the subsidiary controller through the interface 104.

In S210, the CPU 101 transmits controlling signals to the first platen motor drive circuit 123 of the first print control circuit 120. Accordingly, the first platen drive motor 71 is activated to drive the first platen 5 to a print start position.

In S215, the CPU 101 examines as to whether the first obstacle sensor 55 has detected an obstacle based on input signals from the first sensor I/O circuit 124 of the first print control circuit 120. When the first obstacle sensor 55 has detected an obstacle (S215: YES), in S220, the CPU 101 transmits controlling signals to the indicator control circuit 125 of the first print control circuit 120 transmits error signals to the indicator control circuits 125 of the first print control circuit 120 so that the user can be notified of an error, for example, by a warning sound from the speaker 285.

In S225, the CPU 101 transmits controlling signals to the first platen motor drive circuit 123 of the first print control circuit 120 to decelerate or inactivate the first platen drive motor 71 to decelerate or stop the first platen 5.

In S230, the CPU 101 updates the status of the first carriage 26 to "ready" and transmits the status information to the subsidiary controller through the interface 104. The CPU 101 returns to S200 in FIG. 6.

In S215, when the first obstacle sensor 55 has not detected an obstacle (S215: NO), in S235, the CPU 101 examines as to whether the first platen 5 has moved to the print start position based on input signals from the first platen position sensor 291 through the first sensor I/O circuit 124 of the first print control circuit 120. When the first platen 5 has not yet been brought to the print start position (S235: NO), the CPU 101 returns to S215. When the first platen 5 has been moved to the print start position (S235: YES), the CPU 101 proceeds to S240, in which white-ink printing is performed.

White-ink printing according to the present invention is a printing process to form an image solely in the white ink, and the colored-ink printing is a printing process to form an image in the colored inks. The white-ink printing can be effectively applied together with the colored-ink printing to a piece of dark-colored (e.g., black) fabric. Meanwhile, colored-ink printing (see S400) according to the present invention is a printing process to form an image in the colored inks and can be effectively applied to a piece of light-colored (e.g., white) fabric.

In S240, the CPU 101 transmits controlling signals to the first carriage motor drive circuit 122 of the first print control circuit 120, the first print head drive circuit 121, and the first platen motor drive circuit 123 to drive the first carriage 26, the first print head 23, and the first platen 5 in cooperation with one another. More specifically, the first carriage 26 is driven in the main scanning direction to eject the white ink for one line on the recording medium to form a partial image. The platen is thereafter moved in the auxiliary direction for an amount corresponding to one line, and the first carriage 26 is again driven to form a next line of the image. Thus, the image is formed on the fabric in the white ink (i.e., white-ink printing).

In S245, the CPU 101 examines as to whether white-ink printing has completed. When white-ink printing is not completed (S245: NO), the CPU 101 repeats S245. When white-ink printing is completed (S245: YES), the CPU 101 proceeds to S250.

In S250, the CPU 101 updates the status of the first carriage 26 to "ready" and transmits the status information to the subsidiary controller through the interface 104.

In S255, the CPU 101 increments the variable Nw, which indicates a number of printing operations conducted by the first carriage 26 after a latest purging process, by one. The CPU 101 returns to S200 in FIG. 6.

Following S200 in FIG. 6, in S35, the CPU 101 examines as to whether the print data contained in the RAM 103 is data to form the image in the colored inks by driving the second print head 21. If the print data does not represent the image to be formed in the colored inks (S35: NO), the CPU 101 proceeds to S55. If the print data represents the image to be formed in the colored inks (S35: YES), the CPU 101 proceeds to S40.

In S40, the CPU 101 examines as to whether the obstacle sensor 55 has detected an obstacle in the white carriage print process in S200. If the obstacle sensor 55 has detected an obstacle in the white carriage print process (S40: YES), the CPU 101 proceeds to S55, and the printing operation to form the image on the fabric placed on the first platen 5 is ceased. When the obstacle sensor 55 has not detected an obstacle (S40: NO), the CPU 101 proceeds to S45.

In S45, the CPU 101 examines as to whether the color carriage, i.e., the second carriage 22, is ready for the print data. If the second carriage 22 is not ready (S45: NO), the CPU 101 repeats S45 until the second carriage 22 becomes ready. When the second carriage 22 is ready (S45: YES), the CPU 101 proceeds to S50.

In S50, the CPU 101 examines as to whether a variable Nc, which indicates a number of printing operations conducted by the second carriage 22 after a latest purging process, is greater than or equal to a predetermined number N2. Further, the CPU 101 examines as to whether a predetermined time period has elapsed after a latest printing operation conducted by the second carriage 22. If the variable Nc indicates smaller than the predetermined number N2, and the second carriage 22 has been maintained unused for a shorter time period than the predetermined time period (S50: NO), the CPU 101 proceeds to S400. If the variable Nc is greater than or equal to the predetermined number N2 (S50: YES), or the time period in which the second carriage 22 has been maintained unused is longer than or equal to the predetermined time period (S50: YES), the CPU 101 proceeds to S300.

In S300, the CPU 101 executes a color carriage purging process, in which the nozzle surface of the second print head 21 being mounted on the second carriage 22 is purged so that ink remaining in the nozzle surface can be removed. The color carriage purging process will be described hereinbelow with reference to FIG. 9.

When the color carriage purging process starts, in S310, the CPU 101 updates the status of the second carriage 22 to "purging" and transmits the status information to the subsidiary controller (i.e., the CPU 201 of the second controlling circuit 200) through the interface 104.

In S320, the CPU 101 executes a purging process, which is a process similar to the purging process in 120. In the purging process in S320, each component in the purging unit 91 for the second print head 21 replaces the components in the purging unit 41 for the first print head 23, and description of the purging process is omitted herein.

In S330, the CPU 101 initializes the variable Nc to zero and updates an origin of time period to measure the unused time period of the second carriage 22 to the time in which the current purging operation was conducted. The CPU 101 returns to S300 in FIG. 6.

Following S300, in S400, the CPU 101 executes a color carriage print process, in which the image is formed by driving the second print head 21 being mounted on the second carriage 22. The color carriage print process will be described hereinbelow with reference to FIG. 10.

When the color carriage print process starts, in S405, the CPU 101 updates the status of the second carriage 22 to "printing" and transmits the status information to the subsidiary controller through the interface 104.

In S410, the CPU 101 transmits controlling signals to the first platen motor drive circuit 123 of the first print control circuit 120. Accordingly, the first platen drive motor 71 is activated to drive the first platen 5 to a print start position.

In S415, the CPU 101 examines as to whether the first obstacle sensor 55 has detected an obstacle based on input signals from the first sensor I/O circuit 124 of the first print control circuit 120. When the first obstacle sensor 55 has detected an obstacle (S415: YES), in S420, the CPU 101 transmits controlling signals to the indicator control circuit 125 of the first print control circuit 120 transmits error signals to the indicator control circuits 125 of the first print control circuit 120 so that the user can be notified of an error, for example, by a warning sound from the speaker 285.

In S425, the CPU 101 transmits controlling signals to the first platen motor drive circuit 123 of the first print control circuit 120 to decelerate or inactivate the first platen drive motor 71 to decelerate or stop the first platen 5.

In S430, the CPU 101 updates the status of the second carriage 22 to "ready" and transmits the status information to the subsidiary controller through the interface 104. The CPU 101 returns to S400 in FIG. 6.

In S415, when the first obstacle sensor 55 has not detected an obstacle (S415: NO), in S435, the CPU 101 examines as to whether the first platen 5 has moved to the print start position based on input signals from the first platen position sensor 291 through the first sensor I/O circuit 124 of the first print control circuit 120. When the first platen 5 has not yet been brought to the print start position (S435: NO), the CPU 101 returns to S415. When the first platen 5 has been moved to the print start position (S435: YES), the CPU 101 proceeds to S440, in which colored-ink printing is performed.

In S440, the CPU 101 transmits controlling signals to the second carriage motor drive circuit 142 of the second print control circuit 140, the second print head drive circuit 141, and the first platen motor drive circuit 123 to drive the second carriage 22, the second print head 21, and the first platen 5 in cooperation with one another. More specifically, the second carriage 22 is driven in the main scanning direction to eject the colored inks for one line on the recording medium to form a partial image. The first platen 5 is thereafter moved in the auxiliary direction for an amount corresponding to one line, and the second carriage 22 is again driven to form a next line of the image. Thus, the image is formed on the fabric in the colored inks (i.e., colored-ink printing).

In S445, the CPU 101 examines as to whether image forming in the colored inks has completed. When the image is not completed (S445: NO), the CPU 101 repeats S445. When forming the image in the colored inks is completed (S445: YES), the CPU 101 proceeds to S450.

In S450, the CPU 101 updates the status of the second carriage 22 to "ready" and transmits the status information to the subsidiary controller through the interface 104.

In S455, the CPU 101 increments the variable Nc, which indicates a number of printing operations conducted by the second carriage 22 after a latest purging process, by one. The CPU 101 returns to S400 in FIG. 6.

Following S400 in FIG. 6, in S55, the CPU 101 transmits controlling signals to the first platen motor drive circuit 123 to activate the first platen drive motor 71 so that the first platen 5 is moved to a removable position, in which the fabric can be removed from the first platen 5. The process is terminated thereafter.

Although detailed description of the printing operation when the CPU 201 of the second controlling circuit 200 is the main controller and the CPU 101 of the first controlling circuit 100 is the subsidiary controller, the printing operation is performed similarly to the above-described process.

Figure 11:
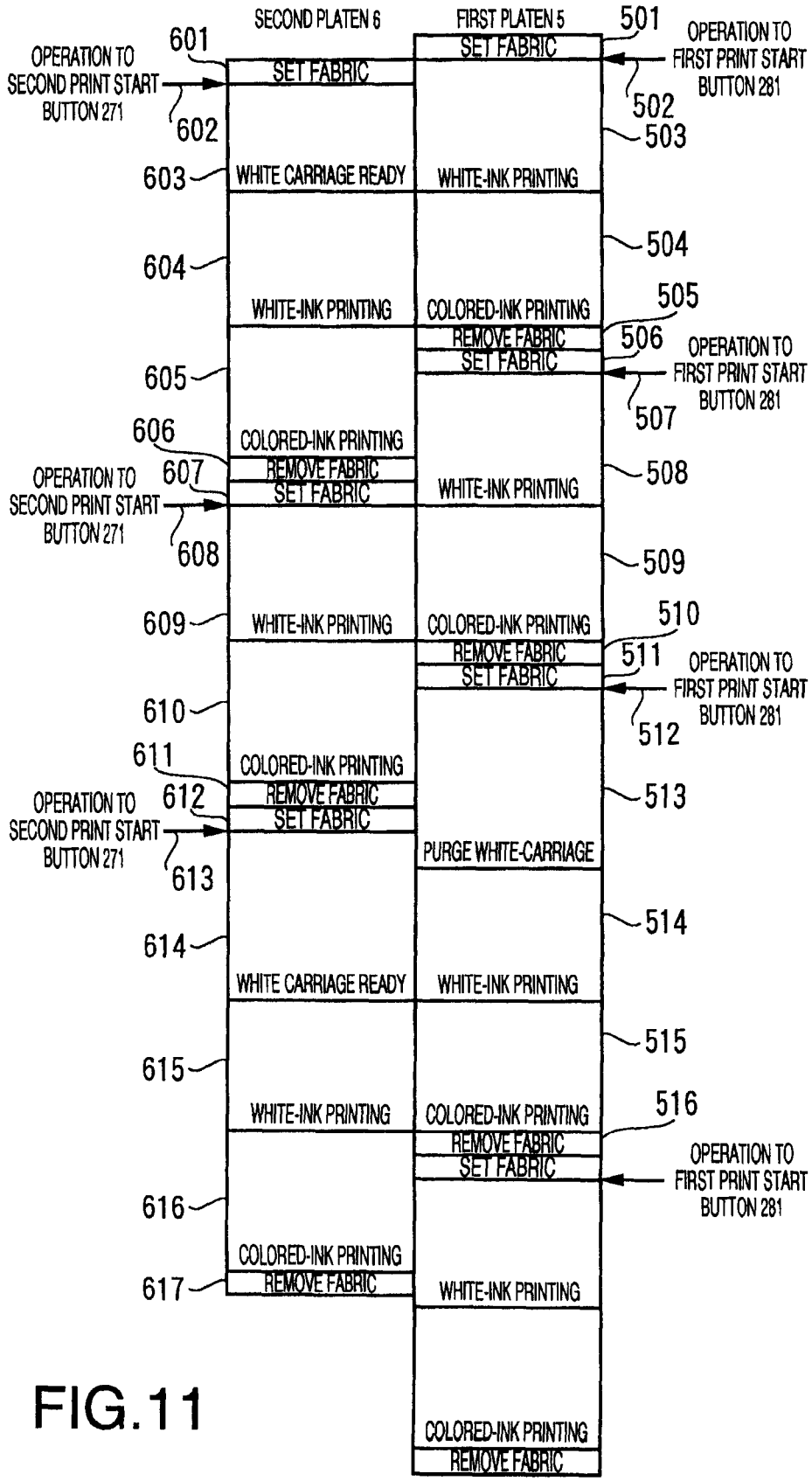
FIG. 11 is a time chart to illustrate behaviors of the inkjet printer when white-ink printing and colored-ink printing are performed in the inkjet printer according to the embodiment of the present invention.
Figure 12:
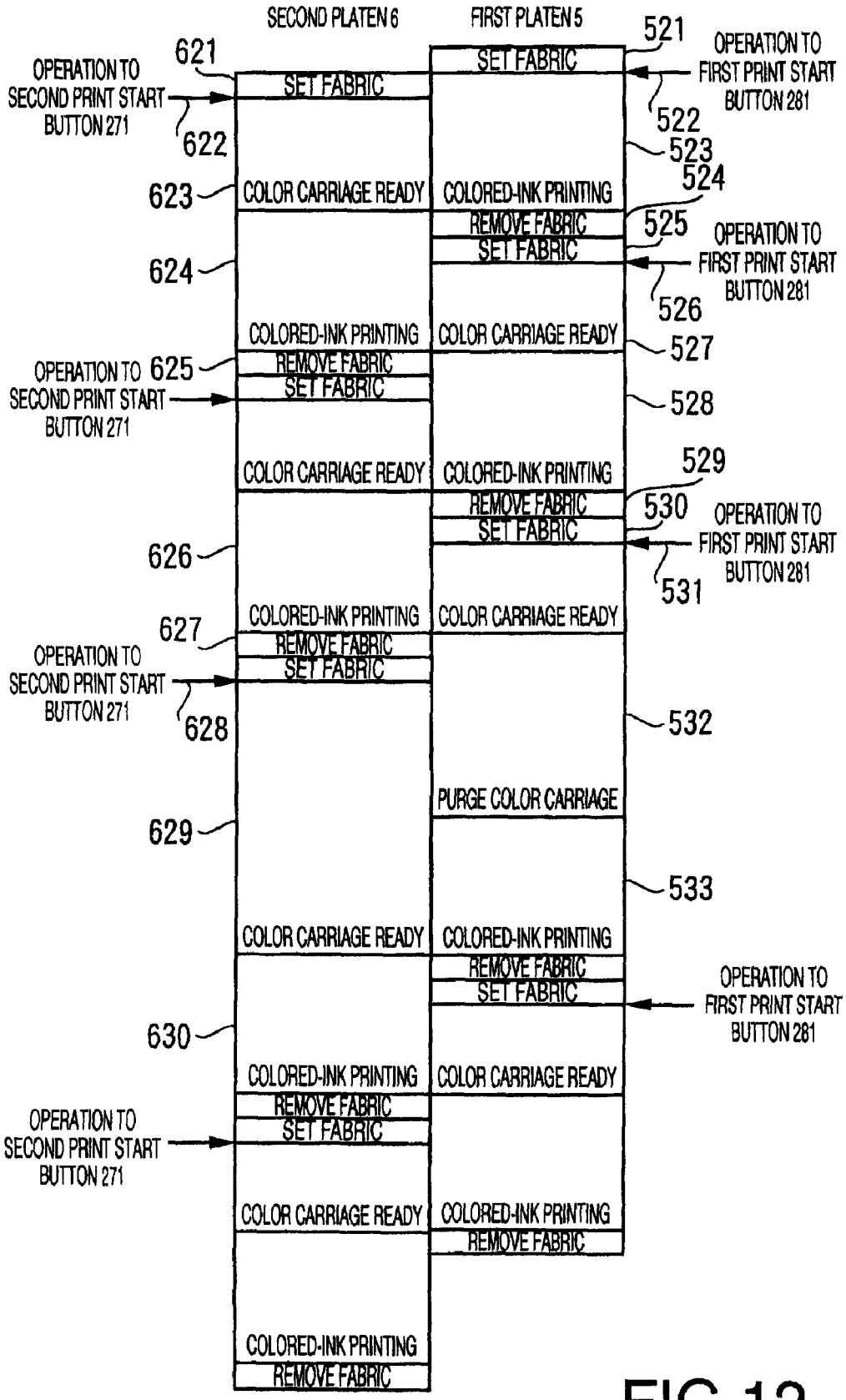
FIG. 12 is a time chart to illustrate behaviors of the inkjet printer when colored-ink printing is performed in the inkjet printer according to the embodiment of the present invention.

Next, with reference to FIGS. 11 and 12, behaviors of the inkjet printer 1 in the printing operation will be described. FIG. 11 is a time chart to illustrate behaviors of the inkjet printer 1 when white-ink printing and colored-ink printing are performed according to the embodiment of the present invention. FIG. 12 is a time chart to illustrate behaviors of the inkjet printer 1 when colored-ink printing is performed according to the embodiment of the present invention. FIGS. 11 and 12 illustrate behaviors of the inkjet printer 1 when same print data is used to print a same image on each piece of fabric on the first and the second platens 5, 6. In FIGS. 11 and 12, lead times required for white-printing and colored printing are illustrated to be substantially equivalent for explanation simplicity. Reference numerals in parentheses in the description below refer to each segmented time period in the printing operation.

As shown in FIG. 11, when the operator sets a first recording medium on the first platen 5 (501) and operates the first print start button 281 in the first operation panel 28 (502), the CPU 101 of the first controlling circuit 100 performs the white carriage print process for the first recording medium by driving the first carriage 26 and the first platen 5 (503) (see S200 in FIG. 6). At this point, the status of the first carriage 26 is updated to be "printing," and the status information is transmitted to the CPU 200 of the second controlling circuit through the interface 104 (see S205 in FIG. 8).

Whilst the white carriage print process is in progress, the operator sets a second recording medium on the second platen 6 (601). When the operator operates the second print start button 271 in the second operation panel 27 (602), the CPU 201 of the second controlling circuit 200 refers to the status of the first carriage 26, which is "printing," and stands by (603).

When the white-ink printing completes, status of the first carriage 26 is updated to be "ready," and the CPU 101 transmits the status information to the CPU 201 of the second controlling circuit 200 through the interface 104 (see S250 in FIG. 8). The CPU 201 releases the first carriage 26 to be driven to perform the white carriage print process for the second recording medium (604).

Meanwhile, the CPU 101, following the white carriage print process, performs the color carriage print process (see S400 in FIG. 6) for the first recording medium by driving the second carriage 22 and the first platen 5 (504). When the color carriage print process is completed, the CPU 101 updates the status of the second carriage 22 to "ready" and transmits the status information to the CPU 201 of the second controlling circuit 200 through the interface 104 (see S450 in FIG. 10). The CPU 101 drives the first platen 5 to the removable position (see S55 in FIG. 6). The operator removes the first recording medium with the image formed thereon from the first platen 5 (505). Thus, the printing processes to a first piece of the first recording medium are completed.

Meanwhile, when the white carriage print process is completed, the CPU 201 updates the status of the first carriage 26 to "ready" and transmits the status information to the CPU 101 of the first controlling circuit 100 through the interface 104 (see S250 in FIG. 8). Thereafter, the CPU 201 refers to the status of the second carriage 22, which is "ready" and successively performs the color carriage print process for the second recording medium by driving the second carriage 22 and the second platen 6 (605). After completion of the color carriage print process, the CPU 201 drives the second platen 6 to the removable position (see S55 in FIG. 6). The operator removes the second recording medium with the image formed thereon from the second platen 6 (606). The printing processes to a first piece of the second recording medium are completed.

Thus, whilst the white carriage print process with the first carriage 26 and the first recording medium is performed, the operation to the second print start button 271 allows the operator to make reservation of the following operations, i.e., the white carriage print process and the color carriage print process.

Next, the operator sets a second piece of the first recording medium on the first platen 5 (506). When the operator operates the first print start button 281 in the first operation panel 28 (507), the CPU 101 performs the white carriage print process for the first recording medium by driving the first carriage 26 and the first platen 5 (508). Upon completion of the white carriage print process, the CPU 101 successively performs the color carriage print process for the first recording medium by driving the second carriage 22 and the first platen 5 (509). When the color carriage print process is completed, the CPU 101 drives the first platen 5 to the removable position. Accordingly, the operator removes the first recording medium with the image formed thereon from the first platen 5 (510). Thus, printing processes to the first piece of the first recording medium are completed.

Meanwhile, the operator sets a second piece of the second recording medium on the second platen 6 (607). When the operator operates the second print start button 271 in the second operation panel 27 (608), the CPU 201 performs the white carriage print process for the second recording medium by driving the first carriage 26 and the second platen 6 (609). In this regard, if the variable Nw indicating a number of printing operations conducted by the first carriage 26 after a latest purging process is greater than or equal to the predetermined number N1 (see S255 in FIG. 8), upon completion of the white carriage print process, the CPU 201 successively performs the color carriage print process for the second recording medium by driving the second carriage 22 and the second platen 5 (610). When the color carriage print process is completed, the CPU 201 drives the second platen 6 to the removable position. Accordingly, the operator removes the first recording medium with the image formed thereon from the second platen 6 (611). Thus, printing processes to the second piece of the second recording medium are completed.

Next, the operator sets a third piece of the first recording medium on the first platen 5 (511). When the operator operates the first print start button 281 in the first operation panel 28 (512), based on the variable Nw being greater than or equal to the predetermined number N1, the CPU 101 performs the white carriage purging process, in which ink in the nozzle surface of the first print head 23 on the first carriage 26 is removed (513) (see also S30 and S100 in FIG. 6). In this regard, the CPU 101 updates the status of the first carriage 26 to "purging" and transmits the status information to the CPU 201 of the second controlling circuit 200 through the interface 104 (see S110 in FIG. 7).

The operator, after operating the first print start button 281 to start printing the image on the third piece of the first recording medium, sets a third piece of the second recording medium on the second platen 6 whilst the white carriage purging process by driving the first carriage 26 is in progress (612). When the operator operates the second print start button 271 in the second operation panel 27 (613), the CPU 201 of the second controlling circuit 200 refers to the status of the first carriage 26, which is "purging," and stands by (614) (see also S25 in FIG. 6).

When the purging process of the first carriage 26 is completed, the CPU 101 maintains the status of the first carriage 26 to be "purging" (see FIG. 7) and performs the white carriage print process by driving the first carriage 26 for the first recording medium on the first platen 5 (514). Accordingly, the CPU 201 maintains the standby state (614). Thereafter, upon completion of the white-ink printing, the CPU 101 updates the status of the first carriage 26 to "ready" and transmits the status information to the CPU 201 of the second controlling circuit 200 through the interface 104 (see S250 in FIG. 8). Accordingly, the CPU 201 releases the first carriage 26 to be driven to perform the white carriage print process with the third piece of the second recording medium (615) (see also S25 and S200 in FIG. 6).

When the color carriage print process is completed (515), the CPU 101 drives the first platen 5 to the removable position. Accordingly, the operator removes the third piece of the first recording medium with the image formed thereon from the first platen 5 (516). Thus, printing processes to the third piece of the first recording medium are completed.

Meanwhile, when the white carriage print process for the second recording medium is completed, the CPU 201 successively performs the color carriage print process by driving the second carriage 22 and the second platen 6 to the second recording medium (616). Upon completion of the color carriage print process, the CPU 201 drives the second platen 6 to the removable position (see S55 in FIG. 6). Accordingly, the operator removes the third piece of the second recording medium with the image formed thereon from the second platen 6 (617). Thus, printing processes to the third piece of the second recording medium are completed.

Thus, whilst the white carriage purging process with the first carriage 26 is performed, the operation to the second print start button 271 allows the operator to make reservation of the following operations, i.e., the white carriage print process and the color carriage print process.

It is to be noted that similar printing processes can be further performed to fourth or more recording media, however, description of those are herein omitted. During the white carriage print process and the color carriage print processes described above, when an error is detected by the obstacle sensors 55, 56, the status of the first carriage 26 or the second carriage 22 is changed to be "ready", and the status information is transmitted to the subsidiary controller (see S230 in FIG. 8 and S430 in FIG. 10). When the subsidiary controller received the status information, and if the print start button 281 or 271 has been operated (i.e., the following processes are reserved), the standby state of the subsidiary controller is released, and the following print process is started.

Next, with reference to FIG. 12, behaviors of the inkjet printer 1 in the printing operation, when solely a colored-ink printing is performed, will be described. FIG. 12 is a time chart to illustrate behaviors of the inkjet printer 1 when colored-ink printing is performed according to the embodiment of the present invention.

As shown in FIG. 12, when the operator sets a first recording medium on the first platen 5 (521) and operates the first print start button 281 in the first operation panel 28 (522), the CPU 101 of the first controlling circuit 100 performs the color carriage print process (see S400 in FIG. 6) for the first recording medium by driving the second carriage 22 and the first platen 5 (523). In this regard, the CPU 101 updates the status of the second carriage 22 to "printing" and transmits the status information to the CPU 201 of the second controlling circuit 200 through the interface 104 (see S405 in FIG. 10).

Whilst the color carriage print process is in progress, the operator sets a first piece of a second recording medium on the second platen 6 (621). When the operator operates the second print start button 271 in the second operation panel 27 (622), the CPU 201 refers to the status of the second carriage 22, which is "printing," and stands by (623) (see S45 in FIG. 6).

When the color carriage print process for the first recording medium is completed, the CPU 101 updates the status of the second carriage 22 to "ready" and transmits the status information to the CPU 201 of the second controlling circuit 200 through the interface 104 (see S450 in FIG. 10). Accordingly, the CPU 201 releases the second carriage 22 to be driven to perform the color carriage print process for the second recording medium (624) (see also S45 and S400 in FIG. 6).

Thereafter, the CPU 101 drives the first platen 5 to the removable position (see S55 in FIG. 6). The operator removes the first recording medium with the image formed thereon from the first platen 5 (524). Thus, the printing processes to a first piece of the first recording medium are completed.

Whilst the color carriage print process for the second recording medium is in progress (624), the operator sets a second piece of the first recording medium on the first platen 5 (525). When the operator operates the first print start button 281 in the first operation panel 28 (526), the CPU 101 refers to the status of the second carriage 22, which is "printing," and stands by (527) (see S45 in FIG. 6).

Meanwhile, when the color carriage print process for the second recording medium is completed, the CPU 201 updates the status of the second carriage 22 to "ready" and transmits the status information to the CPU 101 of the first controlling circuit 100 through the interface 104 (see S450 in FIG. 10). Accordingly, the CPU 101 releases the second carriage 22 to be driven to perform the color carriage print process with the second piece of the first recording medium (528) (see also S45 and S400 in FIG. 6).

Thereafter, the CPU 201 drives the second platen 6 to the removable position (see S55 in FIG. 6). The operator removes the second recording medium with the image formed thereon from the second platen 6 (625). Thus, the printing processes to a first piece of the second recording medium are completed.

Thus, whilst the color carriage print process with the first carriage 26 and the first recording medium (alternatively, the second recording medium) is performed, the operation to the second print start button 271 (alternatively, the first print start button 281) allows the operator to make reservation of the following operations, i.e., the color carriage print process.

Thereafter, whilst the color carriage print process with the second carriage 22 and the second recording medium is in progress (626), the operator sets a third piece of the first recording medium on the first platen 5 (529). When the operator operates the first print start button 281 in the first operation panel 28 (530), the CPU 101 refers to the status of the second carriage 20, which is "printing," and stands by (531) (see also S45 in FIG. 6).

Upon completion of the color carriage print process with the second carriage 22 and the second recording medium, the CPU 201 updates the status of the second carriage 22 to "ready" and transmits the status information to the CPU 101 (see S450 in FIG. 10). In this regard, if the variable Nc is greater than or equal to the predetermined number N2, the CPU 101 performs the color carriage purging process, in which ink in the nozzle surface of the second print head 21 on the second carriage 22 is removed (532) (see also S45, S50, and S300 in FIG. 6). Further, the CPU 101 updates the status of the second carriage 22 to "purging" and transmits the status information to the CPU 201 of the second controlling circuit 200 through the interface 104 (see S310 in FIG. 9).

The operator sets a third piece of the second recording medium on the second platen 6 whilst the color carriage purging process by driving the second carriage 22 is in progress (627). When the operator operates the second print start button 271 in the second operation panel 27 (628), the CPU 201 of the second controlling circuit 200 refers to the status of the second carriage 22, which is "purging," and stands by (629) (see also S45 in FIG. 6).

When the purging process of the second carriage 22 is completed, the CPU 101 maintains the status of the second carriage 22 to be "purging" (see FIG. 9) and performs the color carriage print process by driving the second carriage 22 for the first recording medium on the first platen 5 (533). Accordingly, the CPU 201 maintains the standby state (629). Thereafter, upon completion of the colored-ink printing, the CPU 101 updates the status of the second carriage 22 to "ready" and transmits the status information to the CPU 201 of the second controlling circuit 200 through the interface 104 (see S450 in FIG. 10). Accordingly, the CPU 201 releases the second carriage 22 to be driven to perform the color carriage print process with the third piece of the second recording medium (630) (see also S45 and S400 in FIG. 6).

Thus, whilst the color carriage purging process with the second carriage 22 is performed, the operation to the second print start button 271 allows the operator to make reservation of the following operations, i.e., the color carriage print process for the second recording medium.

It is to be noted that similar printing processes can be further performed to fourth or more recording media, however, description of those are herein omitted. During the color carriage print process described above, when an error is detected by the obstacle sensors 55, 56, the status of the second carriage 22 is changed to be "ready", and the status information is transmitted to the subsidiary controller (see S430 in FIG. 10). When the subsidiary controller received the status information, and if the print start button 281 or 271 has been operated (i.e., the following processes are reserved), the standby state of the subsidiary controller is released, and the following print process is started.

According to the inkjet printer 1 described above, when an operation to the second print start button 271 is entered while the printing operation to the first recording medium on the first platen 5 is in progress, the printing operation to the second recording medium on the second platen 6 is started after completion of the printing operation to the first recording medium (e.g., following the colored-ink printing (523) in FIG. 12) or in between the printing processes (e.g., following white-ink printing (503) and during colored-ink printing (504) in FIG. 11) for the first recording medium. Thus, operations following a currently performed printing operation can be reserved; therefore, the operator is not required to wait at the inkjet printer 1 until the currently performed operation is completed. Because the waiting period for the operator can be omitted, the series of printing operations with a plurality of pieces of recording media can be conducted efficiently.

According to the inkjet printer 1 in the above embodiment, specifically, when the operator starts the printing operation to the first recording medium on the first platen 5 and thereafter operates the second print start button 271, the white carriage print process with the first print head 23 and the first recording medium is performed under control of the CPU 101, and the white carriage print process with the first print head 23 and the second recording medium follows thereafter under control of the CPU 201. Further, the color carriage print process with the second print head 23 and the first recording medium is performed under control of the CPU 101, and the color carriage print process with the second print head 21 and the second recording medium follows thereafter under control of the CPU 201. Thus, the white carriage print processes under control of the CPU 101 and the CPU 201 can be successively performed. Similarly, the color carriage print processes under control of the CPU 101 and the CPU 201 can be successively performed. Therefore, inactive periods for the print heads 23, 21 can be reduced so that operation efficiency can be even more improved.

According to the inkjet printer 1 in the above embodiment, further, when an operation to the second print start button 271 is entered while the first print head 23 is in the "purging" state, the printing process for the second recording medium is started after completion of the printing process for the first recording medium which follows the purging process (e.g., following colored-ink printing (533) in FIG. 12), or in between the printing processes after purging (e.g., following white-ink printing (514) and during colored-ink printing (515) in FIG. 11) for the first recording medium. Thus, operations following a currently performed purging operation can be reserved; therefore, operation efficiency for the operator can be even more improved.

In the above embodiment, height of the recording media is detected by the obstacle sensors 55, 56 at the start of the printing processes with the first and the second recording media. When a height of the first recording medium being higher than a predetermined threshold is detected, whilst a following printing process for the second recording medium is reserved, the printing process for the second recording medium is started so that the inkjet printer 1 can be maintained running with less inactive period. Thus, operation efficiency can be even more improved.

The inkjet printer 1 according to the above embodiment is equipped with two print heads, which include the first print head 23 for white-ink printing and the second print head 21 for colored-ink printing. Therefore, finely-adjusted color gradation can be achieved.

Although an example of carrying out the invention has been described, those skilled in the art will appreciate that there are numerous variations and permutations of the printing apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the CPU 101 of the first controlling circuit 100 can control behaviors of the first platen 5 and white-ink printing with the first carriage 26, and the CPU 201 of the second controlling circuit 200 can control behaviors of the second platen 6 and colored-ink printing with the second carriage 22. In this configuration, when colored-ink printing with the second carriage 22 is conducted to form an image on the first recording medium on the first platen 5, and when white-ink printing with the first carriage 26 is conducted to form an image on the second recording medium on the second platen 6, the CPU 101 and the CPU 201 can exchange controlling information through the interface 104 to control the respective platens.

For another example, two CPUs, which are the CPU 101 and the CPU 201, may not necessarily be provided, but a single CPU to control the entire inkjet printer 1 may be provided.

Further, in the above embodiment, when a printing process for the second recording medium is reserved, driving the second platen 6 to start the printing process is started after completion of a preceding printing process for the first recording medium. However, driving the second platen 6 may not necessarily be paused until completion of the preceding printing process. For example, when a printing process for the first recording medium is reserved, the first platen 5 for the first recording medium may be moved to a print start position (e.g., a first position), in which the first print head 23 starts printing, before completion of the preceding printing process for the second recording medium. Similarly, when a printing process for the second recording medium is reserved, the second platen 6 may be moved to a print start position (e.g., a second position), in which the second print head 21 starts printing before completion of the preceding printing process for the first recording medium. Thus, the first and the second recording media for the following printing process can stand by at the print start positions so that the inkjet printer 1 can be maintained running with less inactive period. Thus, operation efficiency can be even more improved.

In the above embodiment, the status information indicating behaviors of the first carriage 26 and the second carriage 22 includes "purging," "printing," and "ready." However, the status information can include information to indicate other behaviors such as "wiping," which indicates that the nozzle surfaces of the first and the second print heads 23, 21 are being wiped.

Furthermore, in the above embodiment, when white-ink printing and colored-ink printing are performed, and a printing process for the second recording medium is reserved, a white-ink printing process for the second recording medium is started after completion of a preceding white-ink printing process for the first recording medium. However, a white-ink printing process for the second recording medium can be started after completion of white-ink printing and colored-ink printing processes for the first recording medium.

What is claimed is:

1. A printing apparatus capable of forming images successively on a plurality of pieces of recording media, comprising:

at least two platens including a first platen to hold a first recording medium and a second platen to hold a second recording medium;

at least one print head, which is driven according to print data to eject ink onto the first recording medium and the second recording medium;

at least one print head drive unit to drive the at least one print head in a main scanning direction;

at least two platen drive units to drive each of the at least two platens including a first platen drive unit to drive the first platen in an auxiliary direction, which is perpendicular to the main scanning direction, and a second platen drive unit to drive the second platen in the auxiliary direction;

at least one ink cartridge storage unit that is configured to store at least one ink cartridge that stores ink therein and supplies the ink to the at least one print head;

at least two operation input units to be operated by an operator to instruct the printing apparatus to activate printing processes, including a first operation input unit to instruct a first printing process to form an image on the first recording medium by activating the at least one print head, the at least one print head drive unit, and the first platen drive unit and a second operation input unit to instruct a second printing process to form an image on the second recording medium by activating the at least one print head, the at least one print head drive unit, and the second platen drive unit; and a cooperation controller system to control the at least one print head, the at least one print head drive unit, the first platen drive unit, and the second platen drive unit to behave in cooperation with one another, wherein the second printing process is reservable by entering an instruction to start the second printing process through the second operation input unit while the first printing process is in progress; and wherein the cooperation controller system includes a first controller configured to control the first printing process and a second controller configured to control the second printing process, the first controller monitoring status of the first printing process and notifying the status to the second controller, and the second printing process is started one of after completion of the first printing process and during the first printing process based on the status of the first printing process notified by the first controller.

2. The printing apparatus according to claim 1, further comprising:

a plurality of print heads including a first print head and a second print head, each of which is capable of ejecting the ink on to the first recording medium and the second recording medium;

a plurality of print head drive units including a first print head drive unit, which drives the first print head in the main scanning direction, and a second print head drive unit, which drives the second print head in the main scanning direction; and a plurality of ink cartridges including a first ink cartridge to supply ink to the first print head and a second ink cartridge to supply ink to the second print head, wherein the first operation input unit is operated by the operator to instruct the first printing process to form the image on the first recording medium by activating the first print head, the second print head, the first print head drive unit, the second print head drive unit, and the first platen drive unit;

wherein the second operation input unit is operated by the operator to instruct the second printing process to form the image on the second recording medium by activating the first print head, the second print head, the first print head drive unit, the second print head drive unit, and the second platen drive unit; and wherein the cooperation controller system controls the first print head, the second print head, the first print head drive unit, the second print head drive unit, the first platen drive unit, and the second platen drive unit to behave in cooperation with one another so that the second printing process is started one of after completion of the first printing process and during the first printing process based on the status of the first printing process notified by the first controller.

3. The printing apparatus according to claim 2, wherein the cooperation controller system further includes:

a first print head controller, which controls cooperation of the first print head, the first print head drive unit, the first platen drive unit, and the second platen drive unit to form the images on the first recording medium in the first printing process and on the second recording medium in the second printing process; and a second print head controller, which controls cooperation of the second print head, the second print head drive unit, the first platen drive unit, and the second platen drive unit to form the images on the first recording medium in the first printing process and on the second recording medium in the second printing process; and wherein the cooperation controller system controls the first print head, the second print head, the first print head drive unit, the second print head drive unit, the first platen drive unit, and the second platen drive unit to behave in cooperation with one another so that the second printing process controlled by one of the first print head controller and the second print head controller is started one of after completion of the first printing process controlled by one of the first print head controller and the second print head controller and during the first printing process based on the status of the first printing process notified by the first controller.

4. The printing apparatus according to claim 3, wherein the first print head is configured to perform a first ejecting operation, in which the first print head ejects ink onto the first recording medium in the first printing process, and a second ejecting operation, in which the first print head ejects ink onto the second recording medium in the second printing process;

wherein the second print head is configured to perform a third ejecting operation, in which the second print head ejects ink onto the first recording medium in the first printing process, and a fourth ejecting operation, in which the second print head ejects ink onto the second recording medium in the second printing process; and wherein, when the instruction to start the second printing process is entered through the second operation input unit during the first printing process is in progress, the first print head controller controls the first print head to start the second ejecting operation after completion of the first ejecting operation, and the second print head controller controls the second print head to start the fourth ejecting operation after completion of the third ejecting operation.

5. The printing apparatus according to claim 2, further comprising a purging unit to remove air bubbles in the ink in the first print head and the second print head, wherein the first printing process includes a removal operation to remove the air bubbles in the first print head; and wherein the cooperation controller system controls the first print head, the second print head, the first print head drive unit, the second print head drive unit, the first platen drive unit, and the second platen drive unit to behave in cooperation with one another so that the second printing process is started one of after completion of the first printing process and during the first printing process when the instruction to start the second printing process is entered through the second operation input unit while the removal operation to remove the air bubbles in the first print head is in progress.

6. The printing apparatus according to claim 2, wherein the cooperation controller system further includes:

a first drive controller to control the first platen drive unit to move the first recording medium placed on the first platen to a first position, in which the first print head starts forming the image in the first printing process; and a second drive controller to control the second platen drive unit to move the second recording medium placed on the second platen to a second position, in which the first print head starts forming image in the second printing process;

wherein the first printing process includes setting the first recording medium in the first position;

wherein the second printing process includes setting the second recording medium in the second position; and wherein the second drive controller controls the second platen drive unit to move the second recording medium placed on the second platen to the second position when the instruction to start the second printing process is entered through the second operation input unit while the first printing process is in progress.

7. The printing apparatus according to claim 6, further comprising:

a detecting unit to detect heights of the first recording medium on the first platen which is driven by the first platen drive unit and the second recording medium on the second platen which is driven by the second platen drive unit, wherein, when the instruction to start the second printing process is entered through the second operation input unit while the first printing process is in progress, and when a detected height of the first recording medium on the first platen being driven to the first position is greater than or equal to a predetermined threshold, the cooperation controller system controls the first print head, the second print head, the first print head drive unit, the second print head drive unit, and the second platen drive unit to behave in cooperation with one another to start the second printing process including setting the second recording medium in the second position.

* * * * *